US009687858B2

(12) United States Patent
Quiter et al.

(10) Patent No.: US 9,687,858 B2
(45) Date of Patent: Jun. 27, 2017

(54) SEPARATOR DISK PACKAGE WITH SEPARATOR DISKS HAVING LABYRINTH-LIKE FLOW CHANNEL

(71) Applicant: GEA Mechanical Equipment GmbH, Oelde (DE)

(72) Inventors: Kathrin Quiter, Drensteinfurt (DE); Julian Koenig, Paderborn (DE); Thomas Bathelt, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 0 days.

(21) Appl. No.: 14/768,876

(22) PCT Filed: Feb. 14, 2014

(86) PCT No.: PCT/EP2014/052954
§ 371 (c)(1),
(2) Date: Aug. 19, 2015

(87) PCT Pub. No.: WO2014/128063
PCT Pub. Date: Aug. 28, 2014

(65) Prior Publication Data

US 2016/0001302 A1 Jan. 7, 2016

(30) Foreign Application Priority Data

Feb. 20, 2013 (DE) ..... 10 2013 101 654

(51) Int. Cl.
*B04B 1/08* (2006.01)
*B04B 7/14* (2006.01)
*B04B 1/20* (2006.01)

(52) U.S. Cl.
CPC ..... *B04B 7/14* (2013.01); *B04B 1/08* (2013.01); *B04B 2001/2066* (2013.01)

(58) Field of Classification Search
CPC ..... B04B 1/08; B04B 7/14
(Continued)

(56) References Cited

U.S. PATENT DOCUMENTS 809,685 A * 1/1906 Hellstrom ..... B04B 1/08 494/73
920,481 A * 5/1909 Kimball ..... B04B 1/08 494/64

(Continued)

FOREIGN PATENT DOCUMENTS

DE 610 987 C 3/1935
DE 610987 C * 3/1935 ..... B04B 7/14

(Continued)

OTHER PUBLICATIONS

PCT/EP2014/052954, International Search Report (PCT/ISA/220 and PCT/ISA/210) dated Feb. 23, 2015, with partial English translation, enclosing Written Opinion of the International Searching Authority (PCT/ISA/237) (Twelve (12) pages).

*Primary Examiner* — Charles Cooley
(74) *Attorney, Agent, or Firm* — Crowell & Moring LLP

(57) ABSTRACT

A separator disk package for a rotatable drum of a centrifuge for processing of a fluid product in continuous operation is disclosed. The separator disk package includes axially stacked conical separator disks, where, between adjacent separator disks, disk gaps are respectively formed. On one or more of the axially adjacent separator disks are one or more labyrinth-like flow channels, in which, during operation, a direction of flow of a through-flowing product, which is to be clarified of solids, changes on two or more occasions through respectively at least 120°.

18 Claims, 2 Drawing Sheets

(58) Field of Classification Search
USPC ..... 494/68–73
See application file for complete search history.

(56) References Cited

U.S. PATENT DOCUMENTS

| | | | | | |
|---|---|---|---|---|---|
| 1,006,622 | A * | 10/1911 | Bailey | B04B 7/12 | 494/73 |
| 3,133,880 | A * | 5/1964 | Madany | B01D 11/0461 | 494/22 |
| 3,335,946 | A * | 8/1967 | Putterlik | B04B 7/14 | 494/73 |
| 4,142,671 | A * | 3/1979 | Ivin | B04B 1/08 | 494/73 |
| 4,262,841 | A * | 4/1981 | Berber | B04B 7/14 | 494/66 |
| 9,550,192 | B2 * | 1/2017 | Klintenstedt | B04B 1/08 | |
| 2011/0212821 | A1 * | 9/2011 | Mackel | B04B 1/08 | 494/68 |
| 2014/0221187 | A1 * | 8/2014 | Konig | B04B 7/14 | 494/70 |
| 2016/0001302 | A1 * | 1/2016 | Quiter | B04B 1/08 | 494/73 |

FOREIGN PATENT DOCUMENTS

| | | | |
|---|---|---|---|
| DE | 1 769 636 | A | 6/1971 |
| DE | 195 37 268 | C1 | 2/1997 |
| DE | 10 2008 051 867 | A1 | 4/2009 |
| DE | 10 2011 050 046 | A1 | 11/2012 |

* cited by examiner

Fig. 1
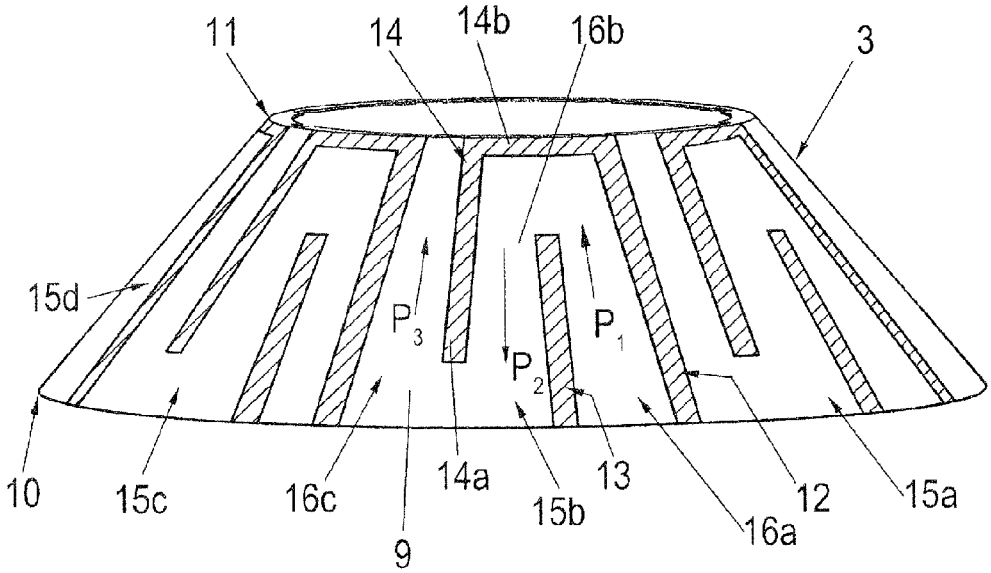
Fig. 2
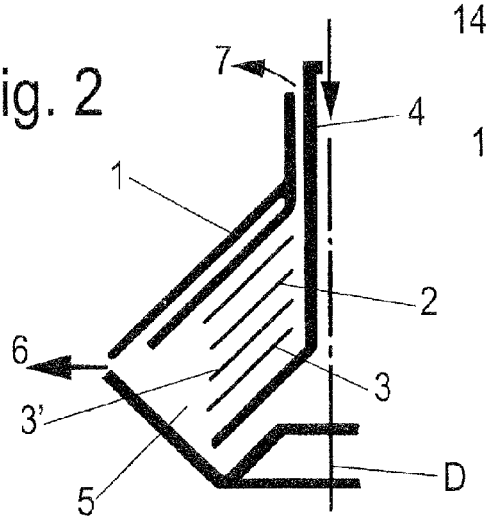
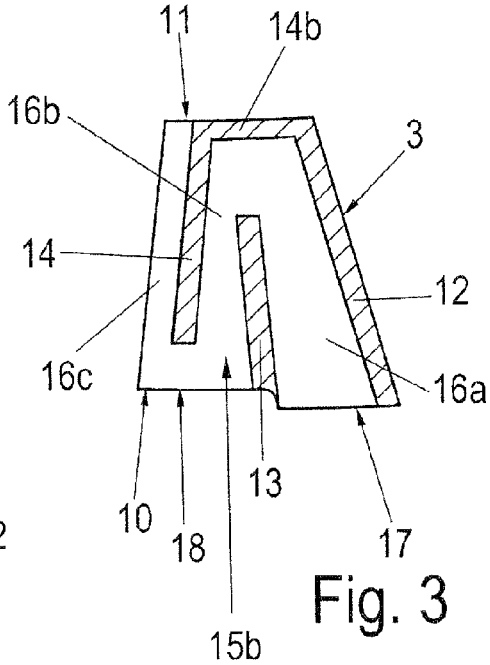
Fig. 3

SEPARATOR DISK PACKAGE WITH SEPARATOR DISKS HAVING LABYRINTH-LIKE FLOW CHANNEL

This application claims the priority of International Application No. PCT/EP2014/052954, filed Feb. 14, 2014, and German Patent Document No. 10 2013 101 654.5, filed Feb. 20, 2013, the disclosures of which are expressly incorporated by reference herein.

BACKGROUND AND SUMMARY OF THE INVENTION

The invention relates to a separator disk package.

A centrifuge having a separator disk package is disclosed, for instance, in DE 10 2008 051 867 A1. Separator disks are commonly produced from metal. Usually, lugs in the form of webs or points are here configured on the separator disk, which lugs on the one hand ensure the spacing of the disks in the axial direction, and on the other hand define flow paths. For the technological background, DE 610 987 PS, DE 195 37 268 C1, U.S. Pat. No. 3,133,880 A, U.S. Pat. No. 3,335,946 and DE 17 69 636, which respectively disclose separator disks having a wide variety of lug arrangements, should also be cited. One aim of the development is to design the separator disks of a disk package of a separator or of some other centrifuge such that, when a product is clarified of solids, an optimal clarification effect is obtained.

The achievement of this aim is the object of the invention.

As a result of the separator disks, having a labyrinth-like channel course comprising an at least dual or multiple diversion of the product at web-like lugs through respectively more than 120°, preferably through more than 150°, particularly preferably through substantially 180° respectively, a guided flow is achieved, which flow enables better utilization of the clarifying area of the separator disks.

In design terms, it is particularly simple if the flow channel or flow channels is/are bounded by elevations in the form of formed-in or formed-on or attached lugs, in particular web-like lugs, of the separator disks.

Furthermore, it is advantageous if preferably each separator disk is divided by first lugs in the peripheral direction into a plurality of peripherally distributed angular segments, so that, during operation of the centrifuge with rotating drum, no or only little liquid can flow from disk segment to disk segment in the peripheral direction.

It is particularly advantageous if the web-like lugs of the separator disks are distributed in such a way on the separator disk, in particular within the angular segments, that a product to be processed is conducted initially radially from outside to in, then radially from inside to out (first diversion through virtually or substantially 180°), and then back radially from outside to in (second diversion through substantially or virtually 180°). In this way, a particularly good utilization of the clarifying area is achieved, since a product remains in the disk gap for a relatively long time before it is led off as a clarified phase to the center. In this way, a very advantageous flow behavior in a flow channel which can also be denoted as Z-shaped or S-shaped is achieved.

It is here, in turn, particularly advantageous if the flow channel or flow channels is/are designed such that in any event a part of a product, which product enters in the outer radial third in at least one rising channel of the separator disk package into gaps between the separator disks, initially flows radially inward, is then diverted radially outward, and then is diverted back radially inward, where it, at the radial inner rim of the separator disk package, is discharged from the latter. As a result of the entry radially on the extreme outside and the exit radially on the extreme inside, the path of that part of the product which flow along the whole of this path becomes, particularly advantageously, very long.

In DE 610 987 PS or in U.S. Pat. No. 3,133,880, for example, specifically a diversion back outward of a product component which initially flows radially inward does not takes place.

According to one variant and also according to a further invention which shall be considered independently, between two radially or substantially radially extending lugs, in particular between the second lug of a disk segment and the first lug of the, in the peripheral direction, next disk segment in the peripheral direction, there is provided a further (preferably fourth) lug, which has a lesser radial height, in any event than the lugs also serving as spacers, so that, between the vertical top side of this further lug and the bottom side of the axially next upper disk, a cross-sectional reduction or a gap is formed in the flow channel, through which product (in particular solid particles) can flow outward out of the disk package.

Below, the invention is described in greater detail, on the basis of several illustrative embodiments, with reference to the drawings.

BRIEF DESCRIPTION OF THE DRAWINGS

FIG. 1 shows a perspective view of a schematically represented separator disk;

FIG. 2 shows a basic diagram of a nozzle-type separator which is suitable for a use of the separator disks from FIG. 1;

FIG. 3 shows a top view of a segment of a second separator disk;

DETAILED DESCRIPTION OF THE DRAWINGS

Figure 4:
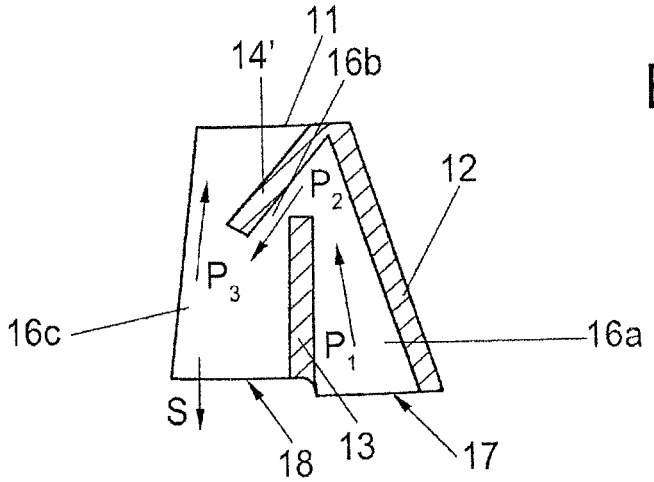
FIG. 4 shows a top view of a segment of a third separator disk.

FIG. 2 shows a centrifuge configured as a separator, here as a nozzle-type separator, comprising a drum 1 which is rotatable about a rotational axis D and into which is respectively inserted a separator disk package 2 made up of separator disks 3, 3' arranged or stacked one above the other. The working of such separators comprising an inlet 4, a solids chamber 5, and outlets 6, 7 for the emptying of solids and or the evacuation of liquid phase(s) has long been common knowledge and therefore requires no further comment. The rotational axis D is here oriented vertically and the drum 2 is preferably of double-conical configuration. It enables a continuous processing, in particular clarification, of a product to be processed. In addition thereto, a separation of the product into two liquid phases of different density can also be realized. For the emptying of solids, nozzles (outlet 6), or openings, closable by piston valves, in the drum are preferably used (not represented).

FIG. 1 shows a schematic representation of a separator disk 3 of the separator disk package 2, which preferably consists of a metal plate.

The respectively adjacent separator disks 3 and 3' are arranged at an axially distance apart, so that a gap, a so-called disk gap, is respectively formed between them.

The separator disk 3 has a conical basic shape 9 (see FIG. 1), so that a succession of a plurality of separator disks 3, 3' also forms a substantially conical separator disk package 2.

The separator disk 3 here has a radial outer rim 10 and a radial inner rim 11. At the separator disks 3, solids are separated from a liquid to be clarified.

On the conical basic shape 9 of the separator disk 3, elevations are formed by lugs 12, 13, 14, which can preferably be formed by a stamping process, but also by a mounting of appropriate webs onto the disks. In FIGS. 1, 3, 4 and 5*a*, although the lugs are shown simplistically in dashed representation, this serves for easier recognizability for identification of the lugs, which can be produced by stamping, welding or the like and protrude axially from the disk.

These lugs 12, 13, 14 serve as spacers and influence the flow. On the bottom side of the separator disks, preferably no lugs are provided. There the separator disks 3 are smooth or have a microstructuring which, in comparison to the lugs 12 to 14 which preferably protrude axially by a few tenths of a millimeter, is axially very small.

The lugs 12 to 14 preferably form a lug pattern, as is evident in FIG. 1.

Initially, the top side of the separator disks 3, preferably each separator disk 3, is divided by first lugs 12 in the peripheral direction into a plurality of peripherally distributed angular segments 15*a, b, c, . . . .*

The first lugs 12 run radially. They extend preferably over at least 90-100% of the radial length of the separator disks, preferably from the outer rim 10 up to the inner rim 11, or up to directly before these rims. In the peripheral direction, preferably no liquid can flow from disk angular segment 15*a* to disk angular segment 15*b*, etc.

In interaction with the further lugs 13, 14, a labyrinth-like flow channel is formed, which provides for an at least single, preferably, however, dual or even triple or multiple diversion of through-flowing product through at least respectively 120°, preferably in each case substantially 180°.

This shall be explained in greater detail below.

In addition to the first lugs 12, distanced or offset in the peripheral direction as well as in the rotational direction D of the centrifuge drum, there is respectively formed for each angular segment 15 *a, b, c . . .* a second lug 13, which likewise extends radially, to be precise preferably directly from the outer rim 10 radially inward, preferably inward from the outer rim 10 over 50% to 80% of the radial extent of the separator disk 3.

Furthermore, for each angular segment 15 *a, b, c . . .*, a third lug 14 is preferably present. According to the embodiment of FIGS. 2 and 3, this third lug, in top view of the separator disk 3, has an L-shape comprising two legs 14*a* and 14*b* oriented at an angle, in particular a right angle, to each other. The third lug 14 passes preferably directly into the first lug 12 or attaches directly thereto.

Preferably, one of the legs 14*a* extends likewise radially. This leg 14*a* lies, distanced in the rotational direction from the second lug 13, between the second lug 13 and the first lug 12 of the, in the rotational direction, next or adjacent disk segment 15*b*. The leg 14*a* extends preferably over more than 50% of the radial extent of the separator disk 3, wherein it is arranged approximately midway between the outer rim 10 and the inner rim 11. In particular, it has a radial distance to the outer rim 10 which amounts to at least 5%, preferably at least 10% of the radial extent of the separator disk 3.

The radially inner end of this leg 14*a* is connected to the first lug 12 by a leg 14*b* extending preferably in the peripheral direction or perpendicular, or substantially perpendicular, to the leg 14*a* and the first lug 12. This lug 14*b* preferably lies, in the peripheral direction, directly next to the inner rim 11.

In this way, in each disk segment a labyrinth-like flow channel is preferably formed in the disk segment 15*a, b, c . . .*, which flow channel extends between the lugs and diverts a liquid twice through virtually or substantially 180° (or virtually 180°).

Product which in an inflow zone 16a between the lugs 12, 13 flows radially from outside into the disk gap initially flows in the radially inward direction, is then diverted around the inner end of the second lug 13, then flows in a second zone 16*b* of the channel in the radially outward direction, and is finally diverted around the outer end of the third lug 14 back radially inward into a zone 16*c*. At the radially outer end of the zone 16*b*, solids are preferably discharged from the separator disk package in the radially outward direction, so that here an outward flow exists.

Essentially, the clarified product next flows between the third lug 14 and the first lug 12 of the, in the rotational direction, next disk segment 15*b* in the third zone 16*c* of the channel radially inward via the inner rim 11 and is led off there. This arrangement is preferably repeated in the peripheral direction.

As a result of the labyrinth-like channel course comprising at least one, or preferably at least dual diversion of the product in the directions P1, P2, P3 through more than 120°, in particular more than 150°, preferably substantially 180°, a guided flow is achieved, which flow enables better utilization of the clarifying area.

FIGS. 3 and 4 further show that the separator disks 3 according to one variant of the previously discussed invention and also an invention which shall be considered independently, distributed in the peripheral direction, can alternately have regions 17, 18 of different outer diameter.

Represented is a top view of one of the angular segments 15. In the regions 17 of somewhat smaller or larger outer diameter (preferably the outer diameter is here 1 to 10 mm larger or smaller than in the regions 18) should preferably lie the entry into the first zone 16*a* of the flow channel. In the regions 18 of smaller or larger diameter, on the other hand, should lie the radial exit for the solid particles. In this way, the path of the product in the disk gap is once again lengthened and the clarification effect optimized.

The separator disk 3 can optionally have openings or recesses, which in interaction, in the mounted state, form with further separator disks 3' a rising channel (not represented). Preferably, the configuration is free of a rising channel, however, since in this way use can particularly advantageously be made of the fact that product or centrifuge material flowing from outside radially into the disk package 2 is respectively multiply diverted on its path radially inward between the separator disks. If rising channels are provided, these are preferably located in the outer radial third of the separator disk package, in order that, in this way too, a relatively long path is covered radially inward from the fluid centrifugal material to be processed. In the region between the lugs, the surface of the conical separator disks is preferably not stepped or wavy, as is shown by U.S. Pat. No. 3,133,880, but rather—apart from possibly present microscopic structures on the disk surface, smooth.

FIG. 4 shows, like FIG. 3, a top view of a single disk segment adjoined in the peripheral direction preferably by further, same-shaped disk segments.

According to FIG. 4, the first and the second lug 12, 13 are radially configured and oriented in the style of FIG. 1.

According to FIG. 4, the third lug 14' is not, however, of L-shaped configuration, but rather is configured as a third lug 14' oriented at an acute angle—preferably at an angle between 30° and 60°—to the first lug 12, which third lug runs obliquely outward from the inner rim 11, so that its radially outer free end protrudes radially outward (and in the peripheral direction) over the radial inner end of the second lug 13. In this way too, a dual diversion through 180° is achieved. The oblique arrangement of the lug 14' enables the solids to slide off radially outward at this third lug 14'. It is clear that it is very easily possible to put the invention into practice through the use of lug patterns of different type.

Figure 5A:
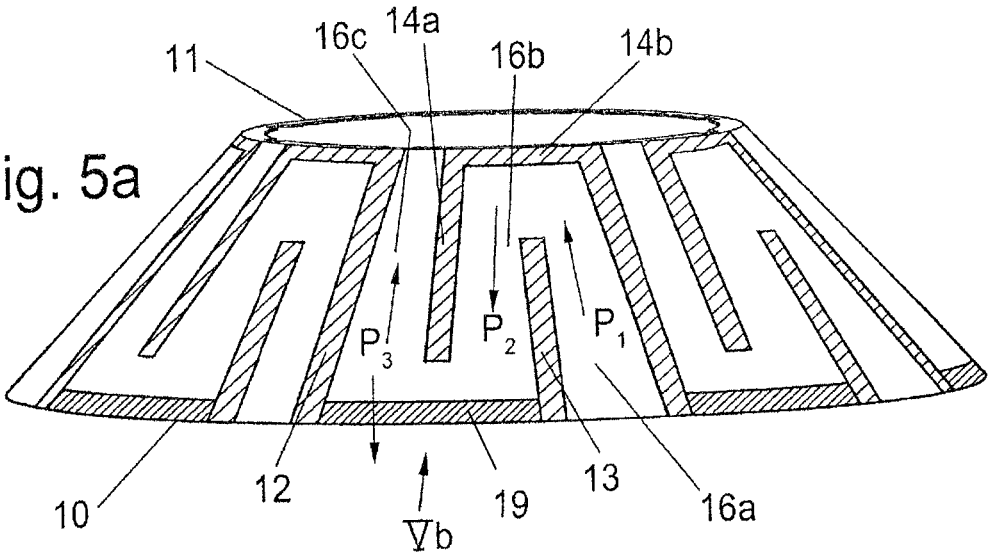
FIG. 5*a* shows a perspective view of a fourth separator disk.
Figure 5B:
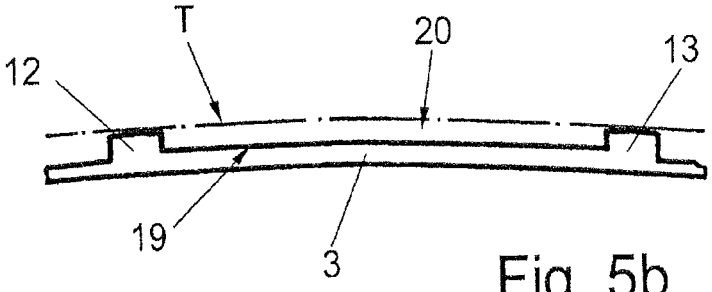
FIG. 5*b* shows a view of a rim portion of the fourth separator disk from FIG. 5*a* in the direction of the arrow F, in enlarged representation in relation to FIG. 5*a*.

According to FIGS. 5*a* and 5*b*, it is provided as an option to provide a fourth lug 19 in the peripheral direction between the second lug 13 of one disk segment and the first lug 12 of the next disk segment—preferably directly before the or on the outer rim 10. This fourth lug 19 has however—see FIG. 5*b*—a lesser radial height than the other lugs 12, 13, 14*a, b* which act as spacers of the disks in the disk package. In this way, between the top side of this fourth lug 19 and the bottom side of the axially next upper disk (indicated in FIG. 5*b* by a dashed line T), a cross-sectional reduction or gap 20 (which generally extends just one or a very few tenths of a millimeter) is formed in the flow channel, by which the flow relationships are so positively influenced that the solids can readily leave the disk package in the outward direction, while the principal flow of the product in the inward direction is positively promoted.

REFERENCE SYMBOLS drum 1
separator disk package 2
separator disks 3, 3'
inlet 4
solids chamber 5
outlets 6, 7
basic shape 9
outer disk rim 10
inner disk rim 11
lugs 12, 13, 14, 14'
legs 14*a, b*
angular segments 15*a, b, c, . . .*
zones 16*a, b, c*
regions 17, 18
lug 19
gap 20
arrows F, S
product stream directions P1, P2, P3

The invention claimed is:

1. A separator disk package for a rotatable drum of a centrifuge for processing of a fluid product in continuous operation, comprising:

a plurality of axially stacked conical separator disks, wherein, between adjacent separator disks, disk gaps are respectively formed;

wherein on one or more of the separator disks are one or more labyrinth-like flow channels, in which, during operation, a direction of flow of a through-flowing product, which is to be clarified of solids, changes on two or more occasions through respectively at least 120°;

wherein the flow channel or flow channels is/are configured such that at least a part of the product, which enters on an outer periphery into the separator disk package on an outer rim into gaps between the separator disks, initially flows radially inward, is then diverted radially outward, and then is diverted back radially inward, where the at least the part of the product, at a radial inner rim of the separator disk package, is discharged.

2. The separator disk package as claimed in claim 1, wherein the flow channel or flow channels is/are bounded by elevations in a form of formed-in or formed-on or attached lugs of the separator disks and by respectively two adjacent separator disks.

3. The separator disk package as claimed in claim 1, wherein the flow channel or flow channels is/are bounded by elevations in a form of formed-in or formed-on or attached lugs on the separator disks or separator disk.

4. The separator disk package as claimed in claim 1, wherein a surface of the separator disks is divided by respective first lugs in a peripheral direction into a plurality of peripherally distributed angular segments such that, during operation, no product flows from angular segment to angular segment in the peripheral direction.

5. The separator disk package as claimed in claim 1, wherein the separator disk package is configured free of a rising channel.

6. The separator disk package as claimed in claim 1, wherein the separator disks, distributed in a peripheral direction, alternately have regions of different outer diameter.

7. A separator drum having a separator disk package as claimed in claim 1.

8. A separator disk package for a rotatable drum of a centrifuge for processing of a fluid product in continuous operation, comprising:

a plurality of axially stacked conical separator disks, wherein, between adjacent separator disks, disk gaps are respectively formed;

wherein on one or more of the separator disks are one or more labyrinth-like flow channels, in which, during operation, a direction of flow of a through-flowing product, which is to be clarified of solids, changes on two or more occasions through respectively at least 120°;

wherein the flow channel or flow channels is/are configured such that at least a part of the product, which enters in an outer radial third in at least one rising channel of the separator disk package into gaps between the separator disks, initially flows radially inward, is then diverted radially outward, and then is diverted back radially inward, where the at least the part of the product, at a radial inner rim of the separator disk package, is discharged.

9. A separator disk package for a rotatable drum of a centrifuge for processing of a fluid product in continuous operation, comprising:

a plurality of axially stacked conical separator disks, wherein, between adjacent separator disks, disk gaps are respectively formed;

wherein on one or more of the separator disks are one or more labyrinth-like flow channels, in which, during operation, a direction of flow of a through-flowing product, which is to be clarified of solids, changes on two or more occasions through respectively at least 120°;

wherein the flow channel or flow channels is/are bounded by elevations in a form of formed-in or formed-on or attached lugs of the separator disks and by respectively two adjacent separator disks wherein the lugs include first lugs distanced from each other in a peripheral direction and a second lug which extends radially.

10. The separator disk package as claimed in claim 9, wherein the second lug extends over 50% to 80% of a radial width of the separator disk.

11. The separator disk package as claimed in claim 9, wherein the lugs include a third lug.

12. The separator disk package as claimed in claim 11, wherein the third lug is attached to one of the first lugs and oriented at an acute angle to the first lug such that a radially outer free end of the third lug protrudes radially outward over an inner end of the second lug.

13. The separator disk package as claimed in claim 11, wherein the third lug has an L-shape including a first leg and a second leg oriented at an angle to each other.

14. The separator disk package as claimed in claim 13, wherein the first leg of the third lug extends radially such that the first leg lies, distanced in a rotational direction from the second lug, between the second lug and one of the first lugs.

15. The separator disk package as claimed in claim 14, wherein the first leg extends over more than 50% of a radial width of the separator disk, wherein the first leg has a distance to an outer rim which amounts to at least 10% of the radial width or extent of the separator disk.

16. The separator disk package as claimed in claim 13, wherein, between a radially inner end of the first leg and one of the first lugs, the second leg is formed or arranged.

17. The separator disk package as claimed in claim 11, wherein the third lug adjoins one of the first lugs or passes directly into one of the first lugs.

18. The separator disk package as claimed in claim 11, wherein the lugs include a fourth lug disposed between one of the first lugs and the second lug, wherein the fourth lug has a lesser radial height than the first lugs and the second lug such that, between a top side of the fourth lug and a bottom side of an axially next upper separator disk, a gap is formed.

* * * * *